US011486130B2

(12) United States Patent
Kang et al.

(10) Patent No.: US 11,486,130 B2
(45) Date of Patent: Nov. 1, 2022

(54) SELF-SUPPORTED PC COLUMN JOINT PART

(71) Applicants: SEOUL NATIONAL UNIVERSITY R&DB FOUNDATION, Seoul (KR); EURO ENGINEERING CO., LTD., Seoul (KR)

(72) Inventors: Thomas Hyun Koo Kang, Seoul (KR); Keun Sam Kim, Seoul (KR)

(73) Assignees: SEOUL NATIONAL UNIVERSITY R&DB FOUNDATION, Seoul (KR); EURO ENGINEERING CO., LTD., Seoul (KR)

( * ) Notice: Subject to any disclaimer, the term of this patent is extended or adjusted under 35 U.S.C. 154(b) by 73 days.

(21) Appl. No.: 17/053,381

(22) PCT Filed: Nov. 1, 2018

(86) PCT No.: PCT/KR2018/013155
§ 371 (c)(1),
(2) Date: Nov. 6, 2020

(87) PCT Pub. No.: WO2019/216507
PCT Pub. Date: Nov. 14, 2019

(65) Prior Publication Data

US 2021/0262218 A1 Aug. 26, 2021

(30) Foreign Application Priority Data

May 10, 2018 (KR) ..... 10-2018-0053586

(51) Int. Cl.
*E04B 1/21* (2006.01)
*E04C 3/34* (2006.01)

(52) U.S. Cl.
CPC . *E04B 1/21* (2013.01); *E04C 3/34* (2013.01)

(58) Field of Classification Search
CPC ..... E04B 1/21; E04B 1/215; E04B 1/4121; E04B 2001/4192; E04C 3/34; E04C 5/165; F16B 5/0233; F16B 5/025
(Continued)

(56) References Cited

U.S. PATENT DOCUMENTS 310,807 A * 1/1885 Ferer ..... E04C 3/34 52/834
2,074,320 A * 3/1937 Bauer ..... E04C 3/34 52/649.6
(Continued)

FOREIGN PATENT DOCUMENTS

CN 109457800 A * 3/2019 ..... E04B 1/21
DE 102013211235 A1 * 12/2014 ..... E04C 5/165
(Continued)

OTHER PUBLICATIONS

European search report dated Jan. 19, 2022 for International Application No. PCT/KR2018/013155.
(Continued)

*Primary Examiner* — Brian D Mattei
*Assistant Examiner* — Joseph J. Sadlon
(74) *Attorney, Agent, or Firm* — LRK Patent Law Firm

(57) ABSTRACT

A self-supported PC column joint part. A plurality of accommodation pieces is buried in the upper surface of a lower member to which a PC column is to be joined, has accommodation spaces having open upper parts, and has female threads. A support bar is provided in a pocket formed in the lower end of the PC column, and includes a body coupled to the upper surface of the pocket to protrude and a head at the lower end of the body so as to be accommodated inside the accommodation space. A fixing piece has a through-hole formed in the center thereof such that the body of the support bar passes therethrough, and has threads formed on the outer
(Continued)

peripheral surface thereof so as to be screw-coupled to the accommodation piece, thereby fixing the head of the support bar.

6 Claims, 9 Drawing Sheets

(58) Field of Classification Search
USPC ..... 52/294; 411/539
See application file for complete search history.

(56) References Cited

U.S. PATENT DOCUMENTS 2,934,935 A * 5/1960 Zerna ..... E04C 5/12 52/223.13
3,263,384 A * 8/1966 Middendorf ..... E04C 5/125 52/223.13
3,678,644 A * 7/1972 Wakefield ..... E04B 1/4114 264/261
4,095,389 A * 6/1978 Outram ..... E04B 1/21 29/525.04
4,516,886 A * 5/1985 Wright ..... E21D 20/025 405/259.6
4,704,053 A * 11/1987 Hipkins, Sr. ..... E21D 20/02 405/259.1
4,735,527 A * 4/1988 Bullivant ..... E02D 5/523 403/267
4,781,006 A * 11/1988 Haynes ..... E04B 1/215 52/601
5,305,573 A * 4/1994 Baumann ..... E04C 5/165 52/848
5,366,672 A * 11/1994 Albrigo ..... B28B 23/043 264/261
5,746,036 A * 5/1998 Angelette ..... E02D 27/42 52/294
6,065,263 A * 5/2000 Taguchi ..... F16B 7/06 52/583.1
6,581,343 B1 * 6/2003 Metelli ..... E04B 7/06 52/583.1
7,275,347 B2 * 10/2007 Hayes ..... E04C 5/12 403/374.1
7,488,135 B2 * 2/2009 Hasegawa ..... F16B 5/0233 403/22
8,132,388 B2 * 3/2012 Nagy ..... E04B 1/04 52/261
8,307,601 B2 * 11/2012 Bonelli ..... E04B 1/04 52/587.1
8,375,678 B1 * 2/2013 Ferrer ..... E04C 5/0604 52/649.3
10,400,438 B2 * 9/2019 Calderon Uriszar-Aldaca ..... E04C 5/165

FOREIGN PATENT DOCUMENTS

FR 1380080 A * 1/1964
GB 2503228 A * 12/2013 ..... B25B 13/08
JP 02308042 A * 12/1990 ..... E02D 27/00
JP 06306873 A * 11/1994 ..... E02D 27/00
JP 07-166611 A 6/1995
KR 10-2001-0095914 A 11/2001
KR 10-0610498 B1 8/2006
KR 10-2006-0102785 A 9/2006
KR 10-2007-0025844 A 3/2007
KR 10-0923565 B1 10/2009
KR 10-2011-0123627 A 11/2011
KR 20150012790 A * 2/2015 ..... E04B 1/185
KR 10-2015-0083217 A 7/2015
KR 20200065764 A * 6/2020 ..... E04B 1/185
WO WO-2020130206 A1 * 6/2020 ..... E04B 1/04

OTHER PUBLICATIONS

Search Report, dated Feb. 19, 2019, for International Application No. PCT/KR2018/013155.
Written Opinion, dated Feb. 19, 2019, for International Application No. PCT/KR2018/013155.

* cited by examiner

SELF-SUPPORTED PC COLUMN JOINT PART

CROSS-REFERENCE TO RELATED APPLICATIONS

The present application is a U.S. National Phase entry from International Application No. PCT/KR2018/013155, filed Nov. 1, 2018, which claims priority to Korean Patent Application No. 10-2018-0053586, filed May 10, 2018, the disclosure of which is incorporated by reference herein in their entirety.

TECHNICAL FIELD

The present disclosure relates to a self-supported PC column joint structure able to join a PC column and a foundation or a PC column and another PC column thereabove without requiring a separate temporary support structure, such as a temporary fixing strut, or a verticality-adjusting object, such as a wire rope.

BACKGROUND ART

Recently, in construction of a structure using steel reinforced concrete, demand for a precast concrete process is increasing due to increasing requirements for reduced construction periods in addition to the increased ratio of labor cost.

In this case, a precast concrete (hereinafter, referred to as PC) is constructed by providing a sleeve below the PC column to connect the PC column to a foundation so that fixing reinforcing rods protruding from the top portion of the foundation are inserted into the sleeve, and the PC column is joined to the foundation by filling and curing non-shrink mortar inside the sleeve (Korean Patent Application Publication No. 10-2001-0095914, FIG. 1).

However, in this method, a separate wire rope must be fixed to the PC column in order to adjust the verticality of the PC column. In addition, only after the non-shrink mortar is cured, the PC column may be fixed to the top portion of the foundation and be self-supported. Thus, there is inconvenience in that the PC column must be supported by constructing a temporary support structure before the non-shrink mortar is cured.

Furthermore, also in a case in which another PC column is disposed on top of and joined to a previously-constructed PC column, a work scaffold or a temporary support structure must be disposed to construct the other PC column so as to be self-supported. Since the position of a joint structure between the PC columns is high, excessive construction work is required, thereby causing construction costs and a construction period to increase.

DISCLOSURE

Technical Problem

Accordingly, the present disclosure has been made keeping in mind the above problems occurring in the prior art, and the present disclosure is intended to provide a self-supported PC column joint structure able to join a PC column and a foundation or a PC column and another PC column thereabove without requiring a separate temporary support structure, such as a temporary fixing strut, or a verticality-adjusting object, such as a wire rope.

Technical Solution

According to embodiment of the present disclosure, provided is a self-supported PC column joint structure including: a plurality of receptacles, each of which is buried in a top surface of a lower member to which a PC column is to be joined, and has an accommodation space with an open top side and a female thread formed in an inner circumferential surface thereof; a support bar provided in a pocket formed in a bottom end of the PC column, in a position corresponding to the receptacle, comprising a body coupled to a top surface of the pocket and protruding downward from the PC column and a head expanded from a bottom of the body and received in the accommodation space of the receptacle; and a fixing member, wherein a through-hole is formed in a central portion of the fixing member such that the body of the support bar extends therethrough, and a thread is formed in an outer circumferential surface of the fixing member to be screw-engaged into the receptacle to fix the head of the support bar, wherein a coupler fixed to a bottom end of a main root within the PC column is buried in the PC column above the pocket, a top end of the body of the support bar is coupled to the coupler, and the head of the support bar is supported to, while being in tight contact with, a bottom surface of the accommodation space of the receptacle, such that vertical load of the main root of the column is directly transferred to the lower member through the support bar.

According to another embodiment of the present disclosure, tool coupling portions may be provided on an outer circumferential surface of the body.

According to another embodiment of the present disclosure, tool coupling portions may be provided in an upper outer circumferential surface or a top surface of the fixing member.

According to another embodiment of the present disclosure, a spiral reinforcing rod may be provided outside the support bar.

According to another embodiment of the present disclosure, the receptacle may include: an outer housing buried in the top surface of the lower member, and having an open top side and a female thread formed in an inner circumferential surface thereof; and an inner housing having defined therein the accommodation space having the open top side, and having a thread in an outer circumferential surface thereof to be screw-engaged into the outer housing so as to be height adjustable.

According to another embodiment of the present disclosure, tool coupling portions may be provided in an upper outer circumferential surface or a top surface of the inner housing.

Advantageous Effects

According to the present disclosure, after a PC column is constructed such that the head of the support bar provided in the pocket in the lower end of the PC column is inserted into the accommodation space of the receptacle buried in the lower member, the fixing member provided outside the body of the support bar is rotated to fix the fixing member to the inner circumferential surface of the receptacle. Then, the fixing member may press and fix the top surface of the head of the support bar. Accordingly, the PC column may be fixed using the receptacle, the support bar, and the fixing member, such that the PC column may be self-supported without a separate temporary support structure, such as a temporary strut.

According to the present disclosure, the coupler may be fixedly buried in the bottom end of the main root of the PC column above the pocket of the PC column, and the verticality of the PC column may be adjusted by adjusting the protruding length of the support bar by screw-engaging the body of the support bar with the coupler. Accordingly, a separate object, such as a wire rope, for adjusting the verticality is unnecessary.

BEST MODE

In order to accomplish the above objective, a self-supported PC column joint structure according to the present disclosure may include: a plurality of receptacles, each of which is buried in a top surface of a lower member to which a PC column is to be joined, and has an accommodation space with an open top side and a female thread formed in an inner circumferential surface thereof; a support bar provided in a pocket formed in a bottom end of the PC column, in a position corresponding to the receptacle, comprising a body coupled to a top surface of the pocket and protruding downward from the PC column and a head expanded from a bottom of the body and received in the accommodation space of the receptacle; and a fixing member, wherein a through-hole is formed in a central portion of the fixing member such that the body of the support bar extends therethrough, and a thread is formed in an outer circumferential surface of the fixing member to be screw-engaged into the receptacle to fix the head of the support bar, wherein a coupler fixed to a bottom end of a main root within the PC column is buried in the PC column above the pocket, a top end of the body of the support bar is coupled to the coupler, and the head of the support bar is supported to, while being in tight contact with, a bottom surface of the accommodation space of the receptacle, such that vertical load of the main root of the column is directly transferred to the lower member through the support bar.

MODE FOR INVENTION

Hereinafter, the present disclosure will be described in detail with reference to the accompanying drawings and exemplary embodiments.

Figure 1:
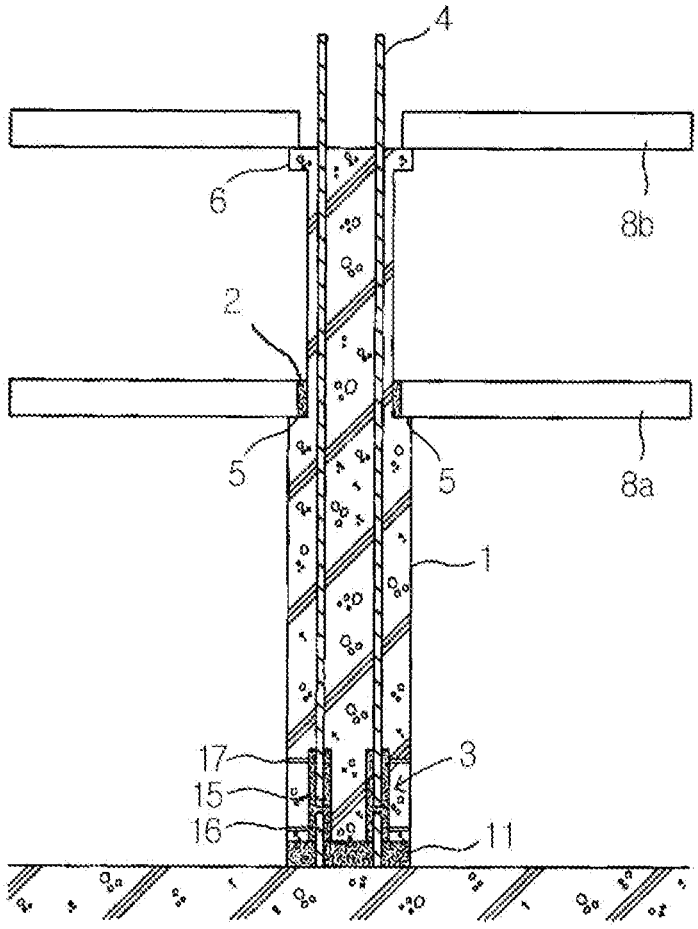
FIG. 1 Related Art
FIG. 1 is a cross-sectional view illustrating a joint structure of the related art for joining a PC column and a foundation.
Figure 2:
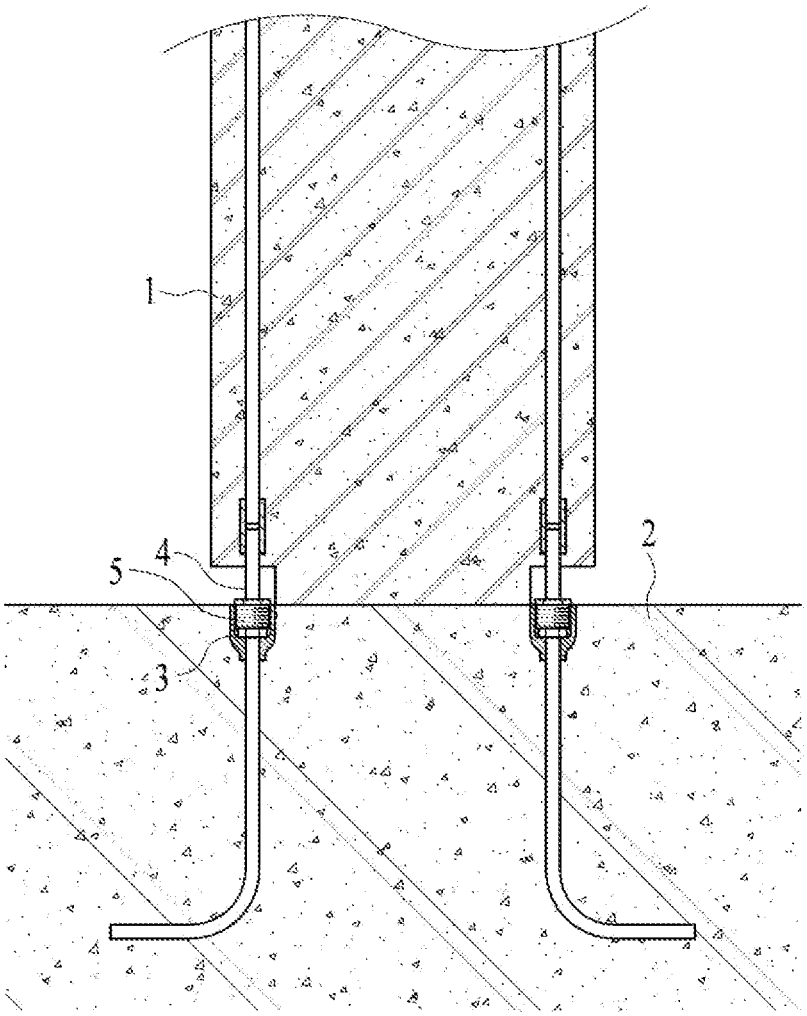
FIG. 2 is a cross-sectional view illustrating the state between a PC column and a lower member joined using a self-supported PC column joint structure according to the present disclosure.
Figure 3:
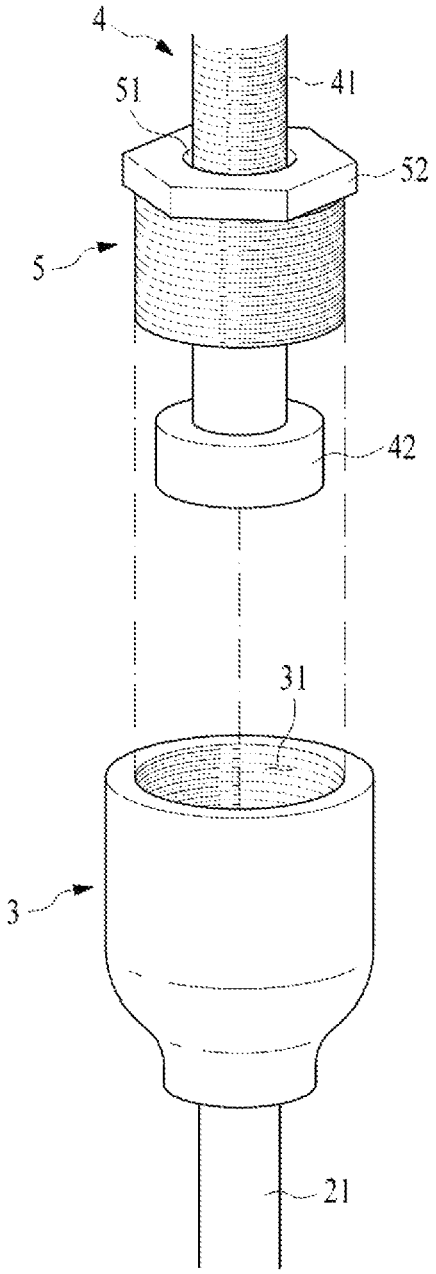
FIG. 3 is a perspective view illustrating the coupling relationship of the self-supported PC column joint structure according to the present disclosure.
Figure 4:
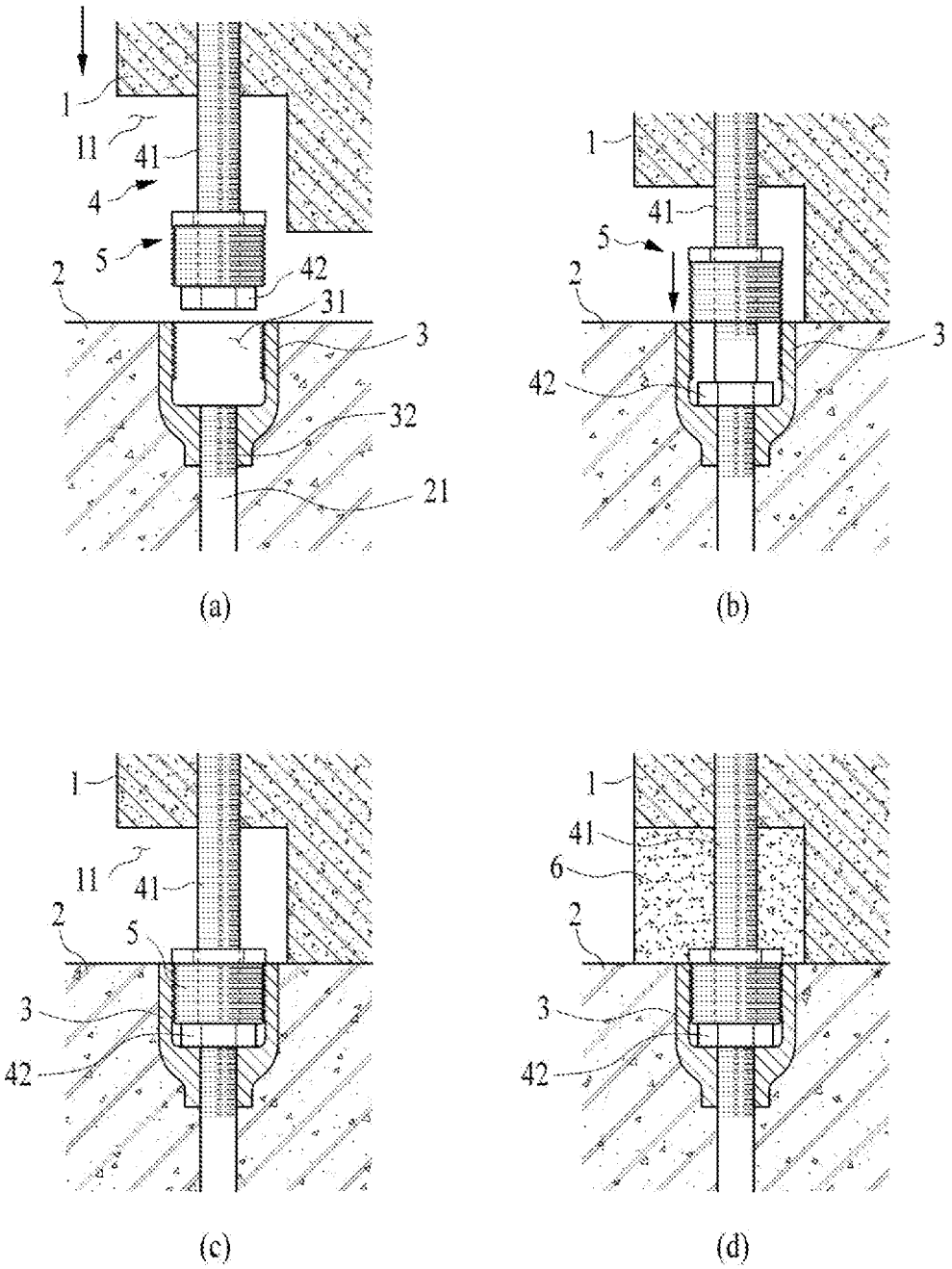
FIG. 4 is a cross-sectional view illustrating a process of joining the PC column and the lower member using the self-supported PC column joint structure according to the present disclosure.

FIG. 2 is a cross-sectional view illustrating the state between a PC column and a lower member joined using a self-supported PC column joint structure according to the present disclosure, FIG. 3 is a perspective view illustrating the coupling relationship of the self-supported PC column joint structure according to the present disclosure, and FIG. 4 is a cross-sectional view illustrating a process of joining the PC column and the lower member using the self-supported PC column joint structure according to the present disclosure.

As illustrated in FIGS. 2 and 3, the self-supported PC column joint structure according to the present disclosure includes a plurality of receptacles 3, a support bar 4, and a fixing member 5. Each of the receptacles 3 is configured to be buried in the top surface of a lower member 2 to which a PC column 1 is to be joined, and has an accommodation space 31 with an open top side and a female thread formed in the inner circumferential surface thereof. The support bar 4 is provided in a pocket 11 formed in the bottom end of the PC column 1, in a position corresponding to the receptacle 3. The support bar 4 includes a body 41 coupled to the top surface of the pocket 11 and protruding downward from the PC column 1 and a head 42 expanded from the bottom of the body 41 and received in the accommodation space 31 of the receptacle 3. The fixing member 5 has a through-hole 51 formed in the central portion thereof such that the body 41 of the support bar 4 extends therethrough and a thread formed in the outer circumferential surface thereof and screw-engaged into the receptacle 3 to fix the head 42 of the support bar 4.

The present disclosure is intended to provide a self-supported PC column joint structure that does not need a separate temporary support structure, such as a temporary fixing strut, or a verticality-adjusting object, such as a wire rope, when joining the PC column 1 to the top of a concrete foundation or the lower member 2, such as a PC column, previously constructed as a lower structure.

The self-supported PC column joint structure according to the present disclosure includes the receptacles 3, the support bar 4, and the fixing member 5.

The receptacles 3 are provided to be buried in the top surface of the lower member 2 to which the PC column 1 is jointed.

Each of the receptacles 3 has the accommodation space 31 with the open upper side and the female thread formed in the inner circumferential surface thereof.

The plurality of receptacles 3 are buried in the top surface of the lower member 2.

The head 42 of the support bar 4, which will be described later, is accommodated in the accommodation space 31.

The fixing member 5 is screw-engaged into the female thread formed in the inner circumferential surface of the receptacle 3, thereby fixing the head 42 of the support bar 4.

As illustrated in FIGS. 2, 4, etc., the receptacles 3 may be fixedly coupled to top ends of vertical reinforcing rods 21 of the lower member 2.

In this case, a coupling hole 32 may be formed in the bottom surface of each of the receptacles 3 such that the corresponding vertical reinforcing rod 21 of the lower member 2 is coupled thereto.

The support bars 4 are provided in the pockets 11 formed in positions corresponding to the receptacles 3 in the bottom end of the PC column 1.

Each of the support bars 4 includes the body 41 and the head 42.

The body 41 is coupled to the top surface of the pocket 11 and protrudes downward a predetermined length from the PC column 1.

The top portions of the bodies 41 of the support bars 4 provided in the pockets 11 are buried and fixed inside the PC column 1.

The head 42 is expanded from the bottom of the body 41 and is received in the accommodation space 31 of the corresponding receptacle 3.

The support bars 4 may be provided in corners of the PC column 1. In some cases, the support bars 4 may be provided on the surface of the PC column 1, i.e. a portion between adjacent column corners, depending on the size of the column.

Fixing using the support bars 4 is only related to the self-support and verticality adjustment of the PC column 1. Thus, it is economical to provide the minimum number of the support bars 4, and the remaining fixing steel bars may be fixed using a sleeve (not shown) in the same manner as in the related art.

The sleeve may be provided inside the PC column 1 or inside the lower member 2.

The through-hole 51 is formed in the center of the fixing member 5 such that the body 41 of the support bar 4 extends therethrough.

Since the fixing member 5 has a thread formed in the outer circumferential surface thereof, the fixing member 5 may be screw-engaged into the receptacle 3. Accordingly, the fixing member 5 may fix the head 42 of the support bar 4.

That is, after the PC column 1 is constructed such that the head 42 of the support bar 4 is inserted into the accommodation space 31 of the receptacle 3, the fixing member 5 provided outside the body 41 of the support bar is rotated to fix the fixing member 5 to the inner circumferential surface of the receptacle 3. Then, the fixing member 5 may press and fix the top surface of the head 42 of the support bar 4.

Accordingly, the PC column 1 may be fixed using the receptacles 3, the support bars 4, and the fixing members 5 at a plurality of positions of the PC column 1, such that the PC column 1 may be self-supported without a temporary support structure.

The fixing members 5 may be configured cylindrical.

As described above, after the PC column 1 is constructed on top of the lower member 2, the pockets 11 are filled with non-shrink mortar 6 using a mold (not shown) covering the pockets 11.

The heights of the pockets 11 may be determined to be higher than the heights of the fixing members 5 such that the fixing members 5 may be inserted into and fastened to the receptacles 3 after the support bars 4 are inserted into the accommodation spaces 31 of the receptacles 3.

Since the PC column 1 may be provided with no reinforcing bands in the positions of the pockets 11, the reinforcing bands must be disposed densely at half the distances of the other portions. Thus, the heights of the pockets 11 may be determined to be minimum values so as not to interfere with the reinforcing bands.

Since the heights of the fixing members 5 may be lowered in the present disclosure, the heights of the pockets 11 may be minimized.

The receptacles 3 and the support bars 4 may be fabricated to be brought to accurate positions using a template plate (not shown) for the accuracy of construction.

Hereinafter, a process of joining the PC column 1 and the lower member 2 using the self-supported PC column joint structure according to the present disclosure will be described with reference to FIG. 4.

First, the PC column 1 is moved above the lower member 2 in consideration of the positions of the receptacle 3 and the support bar 4 (FIG. 4(*a*)).

Afterwards, the PC column 1 is seated on top of the lower member 2 so that the support bar 4 is inserted into the accommodation space 31 of the receptacle 3 (FIG. 4(*b*)).

Subsequently, the fixing member 5 provided outside of the body 41 of the support bar 4 is moved downwards, thereby pressing and fixing the head 42 of the support bar 4 (FIG. 4(*c*)).

In addition, the process is finished by filling the pocket 11 formed in the bottom end of the PC column 1 with non-shrink mortar 6 (FIG. 4(*d*)).

Figure 5:
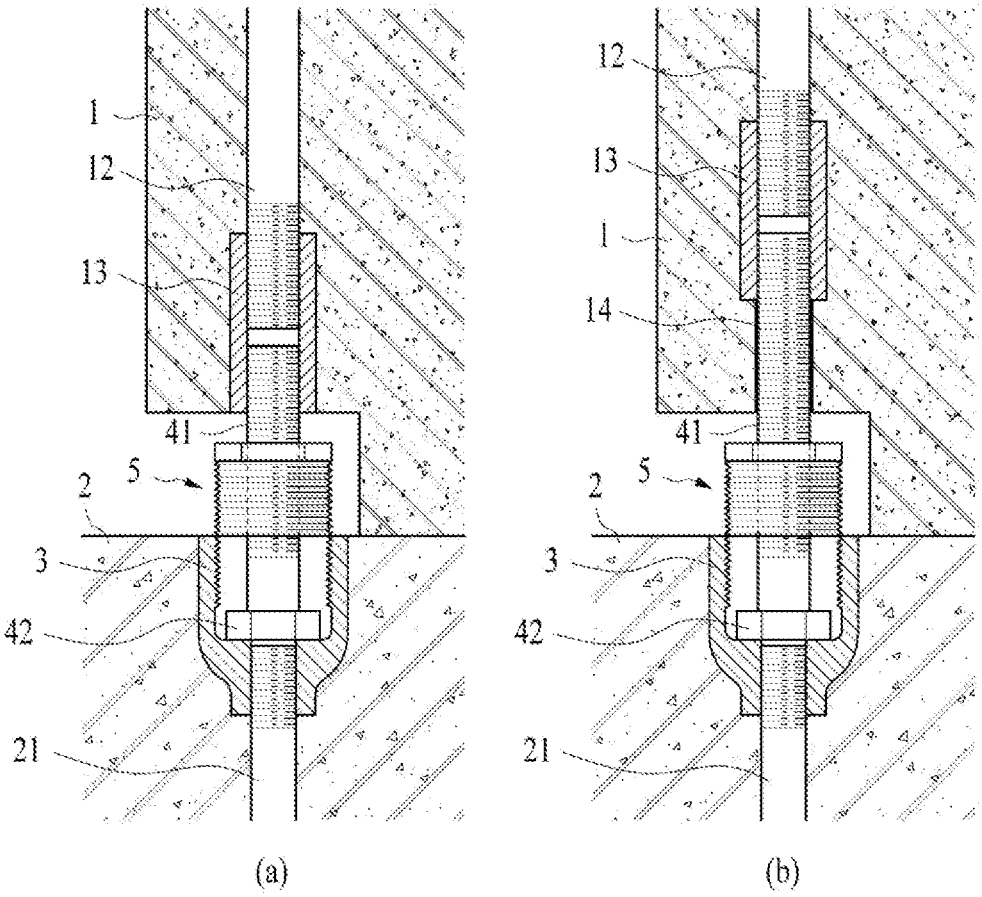
FIG. 5 is cross-sectional view illustrating the self-supported PC column joint structure provided with a coupler according to the present disclosure.

FIG. 5 is cross-sectional view illustrating the self-supported PC column joint structure provided with a coupler according to the present disclosure.

As illustrated in FIG. 5, a coupler 13 fixed to the bottom end of a main root 12 within the PC column 1 is buried in the PC column 1 above the pocket 11. The top end of the body 41 of the support bar 4 may be coupled to the coupler 13. Here, the head 42 of the support bar 4 may be supported to, while being in tight contact with, the bottom surface of the accommodation space 31 of the receptacle 3, such that vertical load of the main root 12 of the column is directly transferred to the lower member 2 through the support bar 4.

The coupler 13 is coupled to the bottom end of the main root 12 of the column to transfer the vertical load of the main root 12 to the lower member 2 through the support bar 4 or the like.

The coupler 13 may be configured to be in contact with the top portion of the pocket 11 as illustrated in FIG. 5(*a*), or may be buried in the PC column 1 while being spaced apart from the top portion of the pocket 11 a predetermined distance as illustrated in FIG. 5(*b*).

When the coupler 13 is spaced apart from the top portion of the pocket 11 a predetermined distance, a through-hole 14 is formed in a portion below the coupler 13, thereby allowing the body 41 of the support bar 4 to extend therethrough.

The protruding length of the support bar 4 may be adjusted by screw-engaging the body 41 with the coupler 13.

In addition, since the support bar 4 may be joined to the PC column 1 later using the coupler 13, the support bar 4 does not protrude from the bottom of the PC column 1 during the fabrication, transportation, or loading of the PC column 1, thereby causing the operation to be convenient.

The coupler 13 may be buried in a position spaced apart upward from the top surface of the pocket 11 in order to be firmly fixed within the concrete of the PC column 1 and distribute stress around the coupler 13 when the stress is transferred through the support bar 4.

In addition, the protruding length of the support bar 4 screw-engaged with the coupler 13 may be adjusted by rotating the support bar 4, so that the verticality of the PC column 1 may be adjusted.

Here, in a position in which the verticality of the PC column 1 is adjusted, the head 42 of the support bar 4 is supported to, while being in close contact with, the bottom surface of the accommodation space 31 of the receptacle 3.

Figure 6:
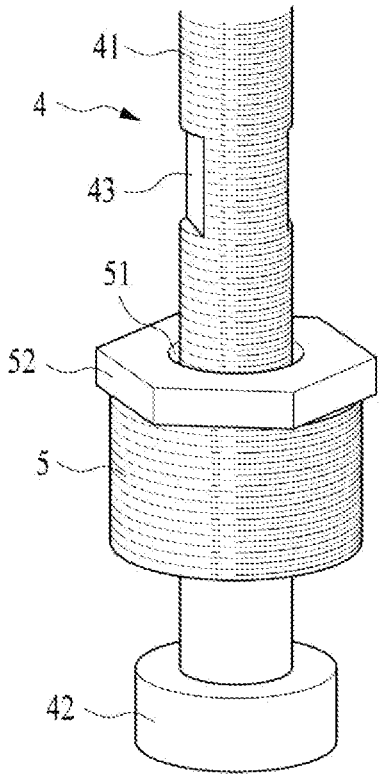
FIG. 6 is a perspective view illustrating the body of the support bar having tool coupling portions.

FIG. 6 is a perspective view illustrating the body of the support bar having tool coupling portions.

Figure 8:
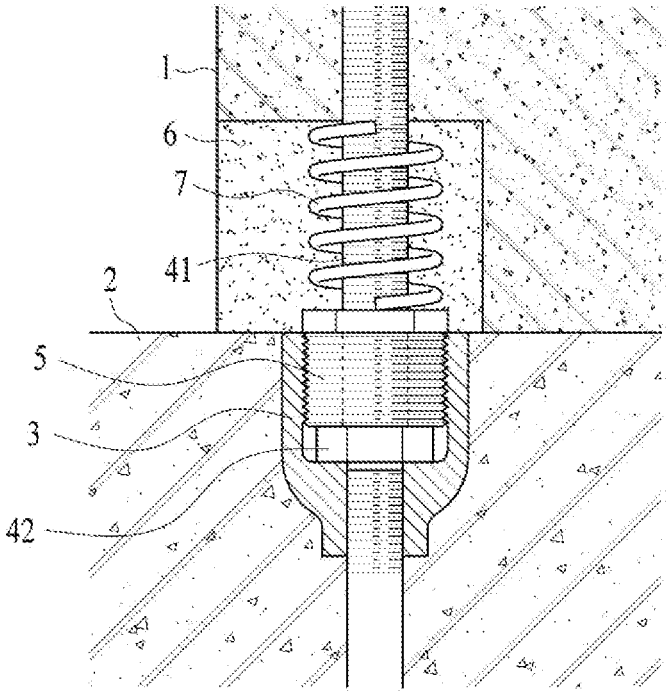
FIG. 8 is a cross-sectional view illustrating the self-supported PC column joint structure provided with a spiral reinforcing rod according to the present disclosure.

As illustrated in FIG. 8, tool coupling portions 43 may be provided on the outer circumferential surface of the body 41.

After the height of the support bar 4 is adjusted in advance to a length by which the verticality of the PC column 1 may be obtained, the PC column 1 may be constructed so that the head 42 of the support bars 4 is inserted into the accommodation space 31 of the receptacle 3. However, in this case, a process of calculating the height of the support bar 4 in accordance with the verticality by performing actual measurement in advance is inconvenient and difficult.

Thus, the head 42 may be supported to, while being in close contact with, the bottom surface of the accommodation space 31 of the receptacle 3 by rotating the support bar 4 in a position in which the PC column 1 is set during the construction of the PC column 1.

In this regard, the tool coupling portions 43 are formed on the outer circumferential surface of the body 41 of the support bar 4, and the support bar 4 may be rotated by holding the body 41 by grasping the tool coupling portions 43 with a tool.

For example, the tool coupling portions 43 may be two or more grasping surfaces formed on the outer circumferential surface of the body 41 or a coupling hole passing through the body 41.

Figure 7:
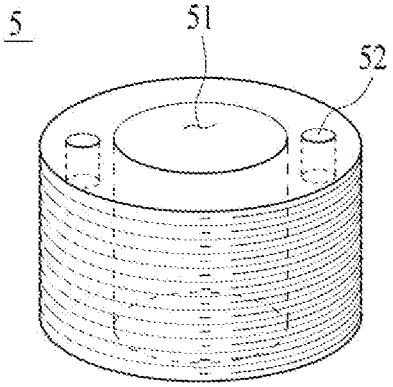
FIG. 7 is a perspective view illustrating the fixing member having tool coupling portions.

FIG. 7 is a perspective view illustrating the fixing member having tool coupling portions.

As illustrated in FIGS. 6, 7, etc., tool coupling portions 52 may be provided in the upper outer circumferential surface or the top surface of the fixing member 5.

The head 42 is required to be firmly pressed by rotating the fixing member 5 to the maximum extent. Thus, the tool coupling portions are formed in the upper outer circumferential surface or in the top surface of the fixing member 5, so that the fixing member 5 may be rotated using a tool.

When the tool coupling portions are formed in the upper outer circumferential surface of the fixing member 5, the tool coupling portions may be two or more grasping surfaces or may be implemented by forming the upper outer circumferential surface of the fixing members 5 to have a polygonal outline (FIG. 6).

Alternatively, when the tool coupling portions are formed on the top surface of the fixing member 5, the tool coupling portions may be formed as two or more insertion recesses.

FIG. 8 is a cross-sectional view illustrating the self-supported PC column joint structure provided with a spiral reinforcing rod according to the present disclosure.

As illustrated in FIG. 8, a spiral reinforcing rod 7 may be provided outside the support bar 4.

The spiral reinforcing rod 7 may be provided outside the body 41 of the support bar 4.

The spiral reinforcing rod 7 reinforces the pocket 11 in the bottom portion of the PC column 1, in which a cross-sectional portion of the PC column 1 is removed, while restraining the non-shrink mortar 6 around the support bar 4.

Figure 9:
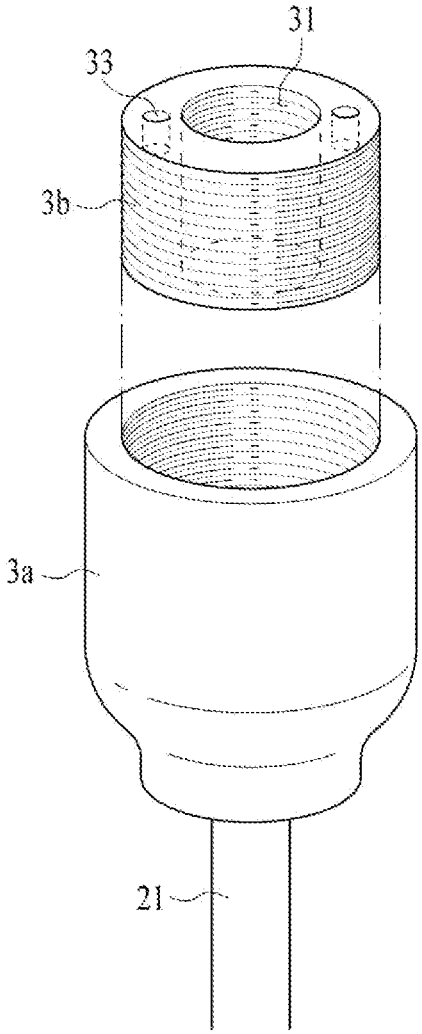
FIG. 9 is a perspective view illustrating the coupling relationship of the receptacle comprised of an outer housing and an inner housing.
Figure 10:
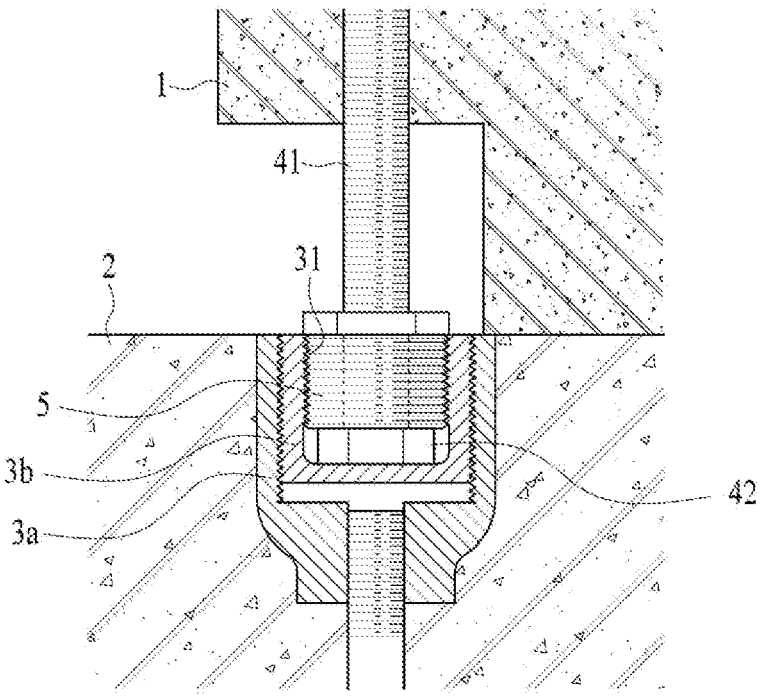
FIG. 10 is a cross-sectional view illustrating the self-supported PC column joint structure having the receptacle illustrated in FIG. 9 according to the present disclosure.

FIG. 9 is a perspective view illustrating the coupling relationship of the receptacle comprised of an outer housing and an inner housing, and FIG. 10 is a cross-sectional view illustrating the self-supported PC column joint structure having the receptacle illustrated in FIG. 9 according to the present disclosure.

As illustrated in FIGS. 9 and 10, the receptacle 3 may include an outer housing 3*a* and an inner housing 3*b*. The outer housing 3*a* is buried in the top surface of the lower member 2, and has an open top side and a female thread formed in the inner circumferential surface thereof. The inner housing 3*b* has defined therein the accommodation space 31 having the open top side. The inner housing 3*b* has a thread in the outer circumferential surface thereof to be screw-engaged into the outer housing 3*a* so as to be height adjustable.

When the support bar 4 is fabricated in a position fixed to the PC column 1, it is difficult to adjust the verticality and the height of the PC column 1.

Thus, the receptacle 3 may be comprised of the outer housing 3*a* and the inner housing 3*b* such that the verticality and the height of the PC column 1 may be adjusted by adjusting the height of the receptacle 3.

The outer housing 3*a* is buried in the top surface of the lower member 2.

The outer housing 3*a* has an open top side and a female thread formed in the inner circumferential surface thereof.

The accommodation space 31 having the open top side is defined inside the inner housing 3*b*. The inner housing 3*b* has a thread in the outer circumferential surface and is screw-engaged into the outer housing 3*a* so as to be height adjustable.

The bottom portion of the inner housing 3*b* is closed to be able to support the bottom surface of the head 42 of the support bar 4.

Accordingly, the bottom surface of the head 42 is supported to, while being in close contact with, the lower surface of the accommodation space 31 of the inner housing 3*b* by rotating and moving the inner housing 3*b* in a position in which the verticality of the PC column 1 is adjusted.

Tool coupling portions 33 may be provided in the upper outer circumferential surface or the top surface of the inner housing 3*b*.

When the tool coupling portions 33 are formed, the inner housing 3*b* may be easily rotated using a tool.

In the embodiment illustrated in FIG. 9, the tool coupling portions 33 are provided as two insertion recesses formed in the top surface of the inner housing 3*b*.

A tool may be coupled to the tool coupling portions 33 in order to prevent the inner housing 3*b* from rotating together with the fixing member 5 during the rotation of the fixing member 5.

INDUSTRIAL APPLICABILITY

In the self-supported PC column joint structure according to the present disclosure, it is possible to press and fix the top surface of the head of the support bar with the fixing member, provided outside the body of the support bar provided in the pocket, by rotating and fastening the fixing member to the inner circumferential surface of the receptacle buried in the lower member. Accordingly, the PC column may be self-supported without a separate temporary support structure, such as a fixing strut, and therefore, the self-supported PC column joint structure according to the present disclosure has industrial applicability.

The invention claimed is:

1. A self-supported PC column joint structure comprising:

a plurality of receptacles (3), each of which is buried in a top surface of a lower member (2) to which a PC column (1) is to be joined, and has an accommodation space (31) with an open top side and a female thread formed in an inner circumferential surface thereof;

a support bar (4) provided in a pocket (11) formed in a bottom end of the PC column (1), in a position corresponding to the receptacle (3), and comprising a body (41) coupled to a top surface of the pocket (11) and protruding downward from the PC column (1), and a head (42) expanded from a bottom of the body (41) and received in the accommodation space (31) of the receptacle (3); and a fixing member (5), wherein a through-hole (51) is formed in a central portion of the fixing member (5) such that the body (41) of the support bar (4) extends therethrough, and a thread is formed in an outer circumferential surface of the fixing member (5) to be screw-engaged into the receptacle (3) to thereby press and fix a top surface of the head (42) of the support bar (4), wherein a coupler (13) fixed to a bottom end of a main root (12) within the PC column (1) is buried in the PC column (1) above the pocket (11), a top end of the body (41) of the support bar (4) is coupled to the coupler (13), and the head (42) of the support bar (4) comes into tight contact with and is supported by a bottom surface of the accommodation space (31) of the receptacle (3), such that vertical load of the main root (12) within the PC column is directly transferred to the lower member (2) through the support bar (4).

2. The self-supported PC column joint structure of claim 1, wherein tool coupling portions (43) are provided on an outer circumferential surface of the body (41).

3. The self-supported PC column joint structure of claim 1, wherein tool coupling portions (52) are provided in an upper outer circumferential surface or a top surface of the fixing member (5).

4. The self-supported PC column joint structure of claim 1, wherein a spiral reinforcing rod (7) is provided outside the support bar (4).

5. The self-supported PC column joint structure of claim 1, wherein the receptacle (3) comprises:

an outer housing (3*a*) buried in the top surface of the lower member (2), and having an open top side and a female thread formed in an inner circumferential surface thereof; and an inner housing (3*b*) having defined therein the accommodation space (31) having the open top side, and having a thread in an outer circumferential surface thereof to be screw-engaged into the outer housing (3*a*) so as to be height adjustable.

6. The self-supported PC column joint structure of claim 5, wherein tool coupling portions (33) are provided in an upper outer circumferential surface or a top surface of the inner housing (3*b*).

* * * * *